United States Patent [19]

Mabboux et al.

[11] Patent Number: 5,075,983

[45] Date of Patent: Dec. 31, 1991

[54] WEARING APPAREL HAVING ENERGY CONSUMING DEVICE

[75] Inventors: Michel Mabboux, Seynod; Jean-Louis Demarchi, Duingt, both of France

[73] Assignee: Salomon S. A., Annecy Cedex, France

[21] Appl. No.: 432,892

[22] Filed: Nov. 7, 1989

Related U.S. Application Data

[63] Continuation-in-part of Ser. No. 409,457, Sep. 19, 1989.

[30] Foreign Application Priority Data

Sep. 19, 1988 [FR] France ..... 88 12197
Nov. 8, 1988 [FR] France ..... 88 14552

[51] Int. Cl.[5] ..... A43B 7/02
[52] U.S. Cl. ..... 36/2.6; 36/117; 36/120
[58] Field of Search ..... 36/2.6, 50, 117, 137, 36/139

[56] References Cited

U.S. PATENT DOCUMENTS

| | | | |
|---|---|---|---|
| 3,663,796 | 5/1972 | Hines et al. | 219/211 |
| 3,977,093 | 8/1976 | Santroch | 36/2.6 |
| 4,180,922 | 1/1980 | Cieslak et al. | 36/2.6 |
| 4,646,350 | 2/1987 | Batra | 36/50 X |
| 4,736,530 | 4/1988 | Lakic et al. | 36/2.6 |
| 4,771,556 | 9/1988 | Kim | 36/139 |
| 4,780,968 | 11/1988 | Bragagnolo | 36/2.6 |

FOREIGN PATENT DOCUMENTS

| | | | |
|---|---|---|---|
| 0146792 | 7/1985 | European Pat. Off. . | |
| 2080146 | 10/1971 | France . | |
| 1136269 | 1/1980 | Italy . | |
| 196850 | 2/1984 | Italy . | |
| 1223883 | 4/1986 | U.S.S.R. | 36/2.6 |
| 8605663 | 10/1986 | World Int. Prop. O. | 36/2.6 |

OTHER PUBLICATIONS

Copy of French Search Report for French Application No. 88.12197.
Copy of French Search Report for French Application No. 88.14552.

*Primary Examiner*—Paul T. Sewell
*Assistant Examiner*—Beth Anne Cicconi
*Attorney, Agent, or Firm*—Sandler, Greenblum, & Bernstein

[57] ABSTRACT

An item of wearing apparel, such as a shoe or boot, particularly for downhill or cross-country skiing, having a foot support zone, a sole, and an upper which may be tightened, in which the shoe or boot has a heating assembly located proximate the sole. The heating assembly includes a heating device such as a burner for producing heat, a plate for diffusion of the heat, the plate being located proximate the foot support zone, a source of fuel, a supply circuit for feeding fuel to the heating device, and a valve for regulating the feeding of fuel to the heating device. The energy supply is automatically turned off when the upper of the shoe or boot is loosened.

35 Claims, 2 Drawing Sheets

WEARING APPAREL HAVING ENERGY CONSUMING DEVICE

This application is a is a continuation-in-part of application Ser. No. 07/409,457, filed Sept. 19, 1989, the subject matter of which is hereby incorporated by reference.

BACKGROUND OF THE INVENTION

1. Field of the Invention

The present invention relates to a downhill or cross-country ski shoe or boot equipped with an energy source supplying an energy consuming device, such as a heating device.

2. Description of Background Information

Ski shoes or boots are known which are intended to improve the comfort of the wearer by means of the incorporation of heating devices. These devices include the electrical type, which use a heating resistance, and the liquid or gaseous fuel type which use a fuel reservoir or tank for a burner positioned in the shoe or boot. Liquid or gaseous fuel heating devices are advantageous, compared to electric devices, in making it possible to obtain a greater autonomy, making them more convenient, and to ensure the temperature and desired comfort within the shoe or boot during a relatively long period of time.

Heating devices using liquid fuel, such as described, for example, in Italian Patent No. 1,136,269 and French Patent No. 2,080,146, generally comprise a rechargeable liquid fuel burner, which is positioned under a heat diffusion plate incorporated in the sole of the shoe or boot so as to be as close as possible to the foot of the wearer of the shoe or boot. Other heating devices which use gaseous fuel include a gas reservoir or tank, supplying fuel through a valve to a catalytic burner, all these elements being totally positioned in the sole of the shoe or boot.

Such heating devices with gaseous fuel are described, for example, in Italian Design Model No. 196,850 and in International Patent Application WO 86/05663. These gaseous fuel heating devices are of the rechargeable gas tank type and it is consequently necessary to provide, in the sole of the shoe or boot which contains the tank, an orifice through which the internal gas tank can be connected to an external gas recharging source.

The known heating devices, either of the elastic type or the liquid or gaseous fuel type, have the disadvantage that once the heating is started, this heating can only be stopped by manual intervention of the wearer of the shoe or boot. That is, the wearer must think of shutting off the heating when he takes off the shoe or boot, which can obviously be forgotten. Therefore, the removed boot is still heated, causing rapid exhaustion of the energy source used and a waste of this energy.

SUMMARY OF THE INVENTION

It is an object of the present invention to improve upon known apparatus. To this end, the present invention is directed to an item of wearing apparel which includes means for receiving an extremity and means for selectively tightening and loosening a portion of said item of wearing apparel about said extremity, the item of wearing apparel further including:

(a) an energy source;

(b) an energy consuming device; and (c) means for controlling the supply of energy from the energy source to the energy consuming device including means for preventing the supply of energy from the energy source to the energy consuming device in response to loosening the portion of the item of wearing apparel about the extremity by the means for selectively tightening and loosening a portion of the item of wearing apparel about the extremity.

According to a specific aspect of the invention, the energy consuming device includes a heating device of either an electric or gaseous type. Specifically, the heating device could be an interchangeable gas fuel cartridge.

According to a further specific aspect of the invention, the item of wearing apparel is a boot, such as an alpine or cross-country ski shoe or boot.

More specifically, the boot includes an upper and the energy source and the means for controlling the supply of energy from the energy source to the energy consuming device is supported by the upper.

Still further according to the invention, the energy for preventing the supply of energy from the energy source to the energy consuming device includes means for detecting the loosening of the portion of the item of wearing apparel, wherein the supply of energy is prevented upon the detection of loosening of the portion of the item of wearing apparel.

In a still further specific aspect of the invention, the means for controlling the supply of energy from the energy source to the energy consuming device includes a manually actuated energy supply switch movable at least between an ON position, in which the supply of energy is permitted between the energy source and the energy consuming device, and an OFF position, in which the supply of energy is prevented from the energy source, wherein the means for controlling the supply of energy from the energy source to the energy consuming device includes means for linking the means for detecting the loosening of the portion of the item of wearing apparel to the energy switch, wherein upon the detection of the loosening of the portion of the item of wearing apparel, the energy switch is permitted to move to the OFF position.

Further according to the invention, the item of wearing apparel includes means for biasing the energy switch toward the OFF position and means for maintaining the energy switch in the ON position against the force of the means for biasing in response to a failure of the means for detecting the loosening of the portion of the item of wearing apparel to detect the loosening of the portion of the item of wearing apparel.

As applied to a boot, the means for detecting the loosening of a portion of the boot comprises a member located proximate the upper of the boot which is moved by means for selectively tightening and loosening the portion of the boot.

It is an additional object of the present invention to provide a ski boot or shoe comprising an upper provided with means for tightening the upper. The boot includes an energy source for supplying an energy consuming device. A device for controlling a supply element of the energy consuming device is connected between the energy source and the energy consuming device, and further includes means actuated by the means for tightening the upper so as to allow the opening of the energy supply element when the upper is tightened and to automatically cause the closing of this supply element in response to the loosening of the upper.

The means actuated by the tightening means includes an element forming a retractable abutment, which is movable between an operative abutment position and an inoperative position, and a pawl for contacting the abutment when it is the operative position to open the energy supply element. A spring biases the retractable element to the inoperative position.

According to one embodiment, the retractable abutment includes a portion of the upper which is cut so as to form a movable flap. The flap is defined by a U-shaped cutout which is joined to an upper portion of the rear wall of the upper and which is detached from the rest of the rear wall of the upper along its two lateral and vertical edges and its lower horizontal and transverse edge. The lower edge is adapted to form the abutment for the pawl. The means for tightening includes at least one tightening cable which surrounds the upper part of the upper where the flap is formed and the cable passes behind the flap. The flap includes a thickness which increases downwardly so that the flap has substantially, in the vertical and longitudinal cross-section, the shape of a trapezoid whose large base constitutes a lower edge which forms the abutment. The flap is biased by the spring towards the exterior of the boot. The spring includes a curved blade which is affixed at its upper end to an upper part of the upper and whose lower curved part rests against an internal surface the flap.

In another embodiment in which the boot is of the front entry type, the tightening of the upper is achieved by means of a cable surrounding the front of the upper, wherein the cable is connected to a tightening lever. The tightening lever is journalled about an axis on an exterior clevis which can slide horizontally with respect the upper. The clevis is connected to a front end of a support strap which extends along the internal surface of the upper. The support strap includes a rear part which extends above the pawl. An internal groove in the rear wall of the upper is adapted to receive the support strap. The support strap is normally biased towards the rear by a spring. The clevis includes a rivet which extends through a horizontal slot provided in the wall of the upper, wherein the rivet is affixed to the front end of the support strap. A spring is positioned in a horizontal slot provided in the front part of the support strap. A wall including a shoulder projects through the slot in the support strap, with the spring resting at one end against the shoulder and at the other end against an edge of the slot.

BRIEF DESCRIPTION OF THE DRAWINGS

Preferred embodiments of the present invention are described below, by way of non-limiting examples, in which further objects, features, and advantages of the present invention will become apparent, with reference to the annexed drawings in which:

FIG. 1 is a vertical and longitudinal sectional view of a boot with an upper having a single portion provided with a gas heating device according to the invention in the position wherein the gas supply is turned on;

DETAILED DESCRIPTION OF THE PREFERRED EMBODIMENTS

As mentioned above, an object of the present invention is to overcome the disadvantages of the above-mentioned known devices by providing a shoe or boot provided with means to automatically turn off the energy supply as soon as the wearer of the shoe or boot loosens the upper thereof.

The downhill or cross-country ski shoe or boot comprises an upper provided with means for tightening. The boot is equipped with an energy source supplying an energy consuming device, such as a heating device, and a device for controlling an element for supplying the energy consuming device connected between the energy source and the consuming device. It includes means activated by the tightening means of the upper of the boot so as to allow the opening of the energy supply element alone when the upper of the boot is tightened and to automatically cause the closing of the supply element as soon as the skier loosens the upper.

The energy consuming device which is incorporated in the boot can be a heating device of the electric type, and in this case, the means activated by the tightening means of the upper of the boot acts on an electric switch which is connected between an electric energy source and a heat-resistance assembly. Alternatively a liquid or gaseous fuel type may be used, in which the means activated by the tightening means of the upper of the boot acts on a device for controlling a valve connected between a tank of gas or liquid fuel and a heating assembly.

Figure 1:
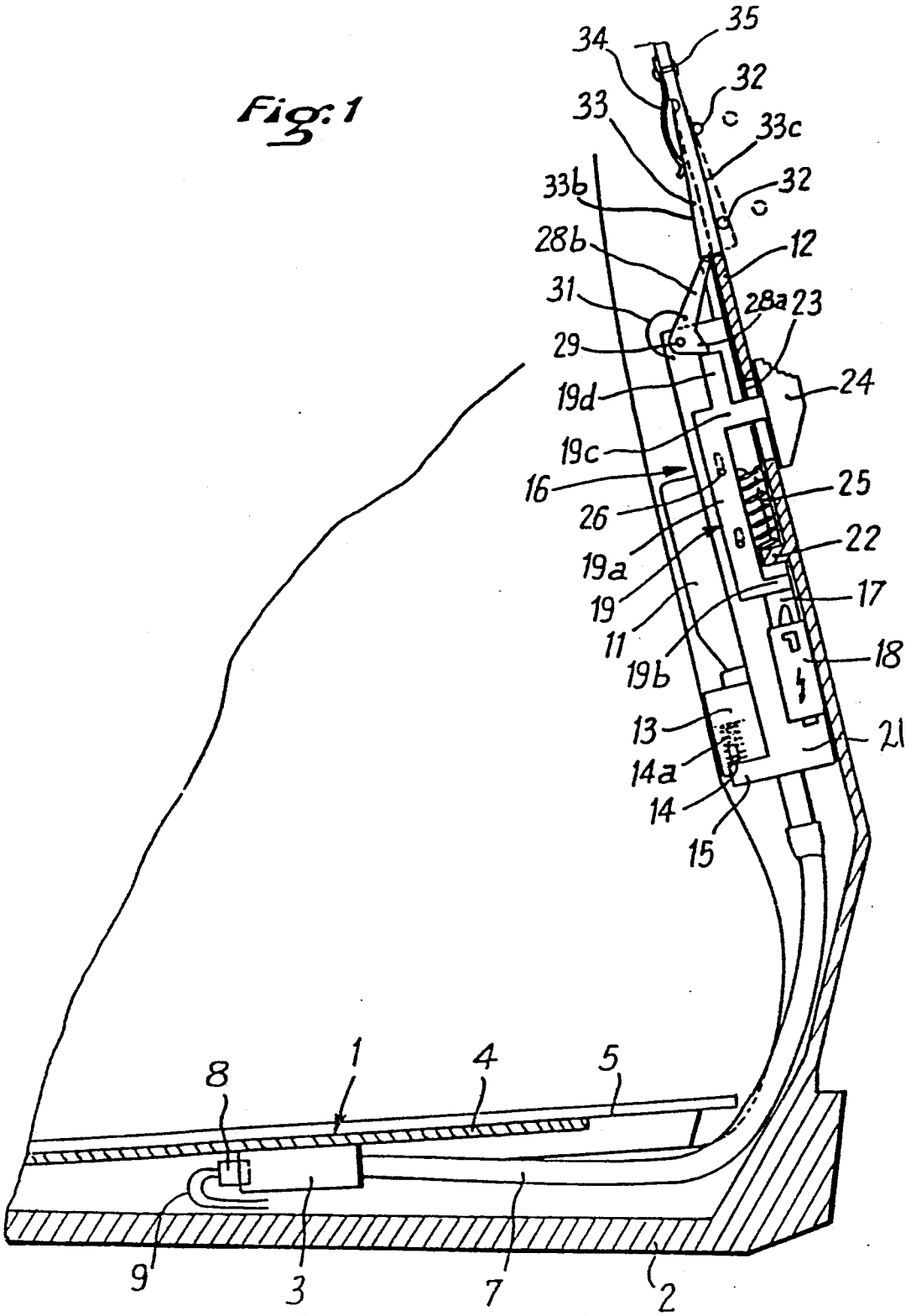
Figure 2:
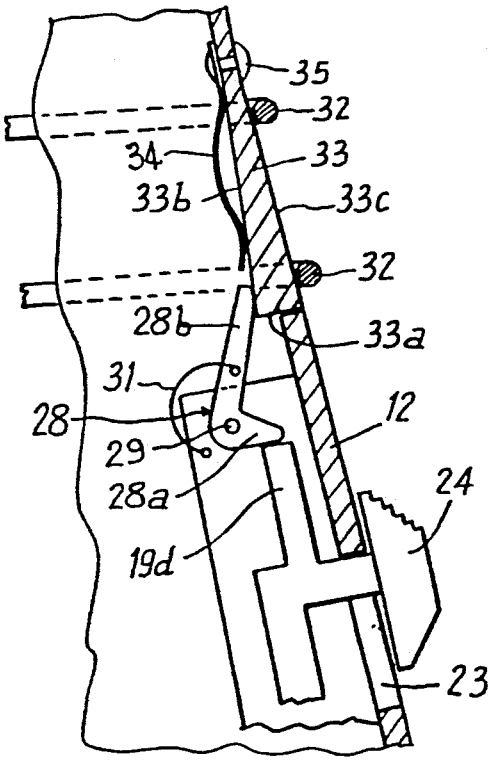
FIGS. 2 and 3 are partial vertical and longitudinal sectional views on an enlarged scale, illustrating the operation of the device for control of the gas supply.
Figure 3:
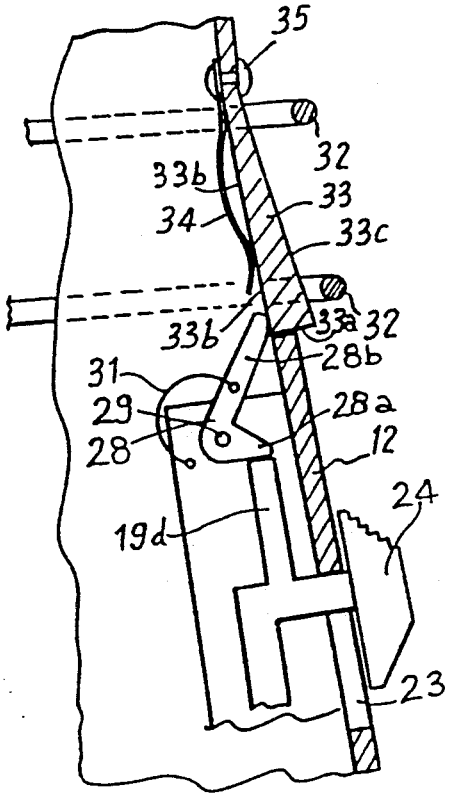

The boot with an upper shown in FIGS. 1-3, which can be a downhill or cross-country ski boot, is of the rear entry type. It is provided with a heating device which in this embodiment is of the gas fuel type. However, the invention also applies in the same way to a boot provided with an electric or liquid fuel heating device or to any other energy consuming device. The heating device includes heating assembly 1 which is positioned in an opening with an appropriate shape provided in the upper part of sole 2 of the boot. Heating assembly includes burner 3 which is affixed, for example, by welding, under heat diffusion plate 4, which is itself placed under internal sole 5 of the boot so as to be able to heat the skier's foot in extreme cold weather. Burner 3 is connected to gas supply tube 7 and electrode 8, which is part of an ignition device, for example of the piezoelectric type to which conductor wires 9 are connected.

Heating assembly is supplied with gas from an interchangeable gas fuel cartridge 11 which is positioned in a housing provided in the rear part of upper 12 of the boot. Gas cartridge 11 is vertically positioned with its gas outlet orifice directed downwardly. In the description which follows, it is understood that the "vertical" direction is the direction in which the upper 12 extends when in fact the rear wall of the upper is slightly inclined towards the front. Gas cartridge 11 is connected at its lower end to supply element 13 which is constituted by an assembly forming a pressure-reducing valve having a control element for opening and closing which includes pin 14 projecting outside the body of valve 13 and which is movable in a vertical slot in the body. Pin 14 is biased downwardly in the direction of its open position by return spring **14*a* which is positioned within pressure-reducing valve 13. Pin 14 is actuated by lug 15 which is part of a control device 16 for the gas supply. Control device 16 acts on pusher 17 of ignitor 18 (of the piezoelectric type, for example) which is connected by electric conductor 9 to electrode 8** so as to produce an ignition spark.

Control device 16 includes two substantially vertical plates which are adjacent to one another, in the vertical and longitudinal planes, that is, a manual control plate 19 of relatively short height and an actuation plate 21 of greater height for actuation of valve 13, which extends both above and below plate 19. Plate 21 for actuation of valve 13 has a generally rectangular shape, and includes on its lower part, lug 15 which extends under pin 14 and is in contact therewith. Manual control plate 19 is substantially C-shaped and is open towards the rear. It includes vertically member 19*a*, lower wing 19*b*, and upper wing 19*c*. Lower wing 19*b* actuates pusher 17 of the piezoelectric ignitor 18 and is located between the upper surface of pusher 17 and internal projection 22 of the rear wall of upper 12 of the boot. Upper wing 19*c* of manual control plate 19 extends outside the rear wall of the upper 12, by passing through vertically elongated slot 23. Control knob 24 is fixed to the external end of wing 19*c*. The two plates 19, 21 are constantly biased upwardly by compression spring 25 which rests on the upper surface of internal projection 22.

The two plates 19 and 21 are coupled to one another by means permitting relative vertical movement of manual control plate 19 with respect to actuation plate 21. In particular, member 19*a* of manual control plate 19 includes two lugs 26 which are vertically aligned and are respectively engaged in vertically aligned slots 27 which are provided in actuation plate 21.

Manual control plate 19 also includes at its upper part a lug 19*d* which extends upwardly and acts on pawl 28 which is journalled about a horizontal and transverse axis 29 on the upper part of the actuation plate 21. Pawl 28 is in the form of a lever with two arms extending in the direction of the rear wall of upper 12. The end of lower arm 28*a* of pawl 28 is in contact with the upper end of actuation lug 19*d* and the upper arm 28*b* of the pawl extends upwardly as far as the rear wall of upper 12. Pawl 28 is biased in a clockwise direction by spring 31 so that its upper arm 28*b* is constantly pushed in the direction of the rear wall of upper 12.

The ski boot shown in FIG. 1 is provided with means for tightening upper 12 around the lower leg of the skier. In this embodiment, the tightening means include cables 32 surrounding the upper portion of the upper and which are connected to a tightening device of any known manually maneuverable type. Cables 32 extend behind one part of the rear wall of upper 12 which is cut to provide a movable flap 33. More particularly, flap 33 is defined by a U-shaped cutout that remains adjacent to the upper portion of the rear wall of upper 12 and it is detached from the rest of the wall of upper 12 along its two lateral and vertical edges and its lower horizontal and transverse edge 33*a*. Lower edge 33*a* is adapted to form an abutment for the end of upper arm 28*b* of pawl 28. Flap 33 has on its part where cables 32 rest, a thickness which increases towards the bottom so that the flap 33 has substantially the shape of a trapezoid in vertical and longitudinal section, whose large base constitutes lower edge 33*a* which forms an abutment on flap 33. Moreover, flap 33 is biased by spring 34, which tends to push it towards the outside of the boot. In the rest position, i.e., when the upper 12 is not tightened around the skier's lower leg, flap 33 is in the position shown in FIG. 3 where its internal surface 33*b* is substantially even with the internal surface of the rear wall of upper 12 while its external surface 33*c* projects downwardly towards the exterior. Return spring 34 of flap 33 is preferably a spring with a curved blade which is affixed at its upper end, for example by rivet 35, to the upper part of the rear wall of upper 12 and whose lower curved part which is concave facing the flap 33, rests against the internal surface 33*b* of flap 33.

When the skier, after having put on his boot, tightens the upper 12 around the lower leg by cables 32, the force exerted by cables 32 on external surface 33*c* of flap 33 causes the retraction of flap 33 within the upper as shown in FIG. 2. In this position, upper arm 28*b* of pawl 28, which rests against the lower part of internal surface 33*b* of flap 33, is pushed slightly towards the interior and the device 16 for control of the gas supply is normally in the closed position. Manual control plate 19 is in effect pushed into its extreme upper position by spring 25, with lower wing 19*b* being in contact with projection 22. Moreover, actuation plate 21 is also pushed by spring 25 into the extreme upper position and its lower lug 15 holds the pin 14 in its extreme upper position which corresponds to the closing of the valve.

If the skier wishes to turn on the heating device, he pushes downwardly on control knob 24, which has the effect of lowering the two plates 19 and 21 against the force of return spring 25. The lowering of lug 15 frees the pin 14 which is then pushed into the lower open position by spring 14*a* so that valve 13 opens and the gas can flow to burner 3. Since plate 19 follows the lowering movement of control knob 24 beyond the intermediate open position, it pushes, by its lower wing 19*b*, pusher 17 of the piezoelectric ignitor 18, which then causes the production of a spark in electrode 8 to ignite the gas. After release, control knob 24 automatically returns, under the action of return spring 25 to the intermediate open position which is shown in FIG. 1. It is retained in this position because the pawl 28 is then latched as is shown in FIG. 1. In effect, in the course of the lowering movement of actuation plate 21, upper arm 28*a* of pawl 28 slides on internal surface 33*b* of the flap 33 and when it arrives just underneath lower edge 33*a* of the flap, pawl 28 pivots in a clockwise direction about its axis 29 under the bias of spring 31. The upper end of upper arm 28*a* of pawl 28 engages under lower edge 33*a* of flap 33 and is immobilized by the lower edge. Pawl 28 being thus latched, its lower arm 28*a* constitutes a fixed abutment for upper lug 19*d* of plate 19, which prevents the automatic return of the two plates 19 and 21 into the closed position. However, the skier may turn off the heating at any time, by pulling the control knob 24 upwardly. In this case, lug 19*d* presses on the pawl 28 and causes it to pivot in a counterclockwise edge 33*a* of flap 33. Then, the two plates 19, 21 can automatically slide upwardly under the action of return spring 25 to pass into the closed gas supply position.

According to the preceding description, it can be seen that for the pawl 28 to be locked in position and to constitute an abutment to hold the plates 19 and 21 in the open gas position, it is necessary that the flap 33 be pushed into upper 12; that is, cables 32 must be tightened around upper 12. Consequently, if the skier forgets to turn off the heat before he opens the upper of the boot, the turning off of the gas supply of burner 3 automatically occurs. In effect, flap 33 is then pushed towards the exterior of the boot as soon as cables 32 are loosened under the action of return spring 34 to move to the position shown in FIG. 3 in which its internal surface 33*b* is substantially even with the internal surface of the rear wall of upper 12. Consequently, if device 16 for control of the gas supply is in the open position in which it was retained by pawl 28 in abutment against lower edge 33*a* of flap 33, the pawl 28 then escapes the abutment, which permits the two plates 19, 21 to automatically slide upwardly under the action of the return spring 25 to pass into the closed gas supply position.

Figure 4:
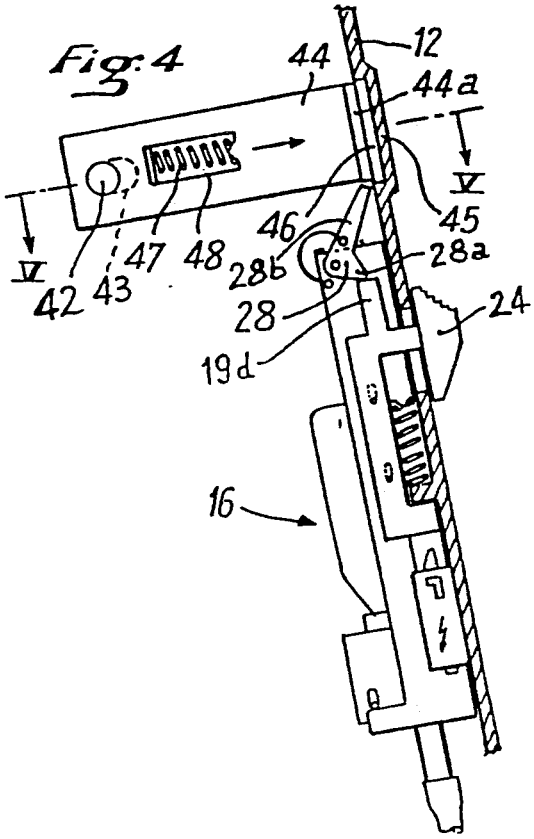
FIG. 4 is a vertical and longitudinal sectional view of an alternative embodiment of the invention.
Figure 5:
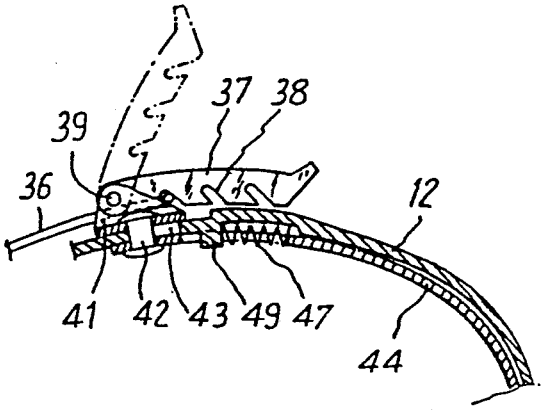
FIG. 5 is a horizontal sectional view taken along line V—V of FIG. 4.

In the alternative embodiment shown in FIGS. 4 and 5, the boot is of the front entry type and the tightening of upper 12 of the boot is achieved by means of cable 36 which surrounds the front of the upper and which is hooked to pivoting lever 37 which is provided with several hooking notches 38 to obtain various degrees of tightening. Tightening lever 37 is journalled about axis 39 on exterior clevis 41 which can slide horizontally with respect to the wall of upper 12. Clevis 41 includes rivet 42 which extends through horizontal slot 43 which is provided in the wall of upper 12. Rivet 42 is affixed within upper 12 to a front end of support strap 44 which extends along the internal surface of upper 12. Support strap 44 includes rear part 44*a* which extends above pawl 28 of control device 16 of the gas supply. At this location, the rear wall of upper 12 includes a portion 45 which projects towards the exterior of the boot and includes an internal groove 46 whose transverse cross-section corresponds to that of support strap 44, so that rear part 44*a* of strap 44 can be retracted into groove 46. Support strap 44 is normally biased towards the rear by compression spring 47. Spring 47 is positioned in horizontal slot 48 which is provided in the front part of support strap 44 and it rests at its front end on a shoulder 49, which projects in slot 48 in the wall of upper 12. Spring 47 rests at its rear end on the rear edge of slot 48.

When upper 12 of the boot is tightened on the skier's lower leg, tightening lever 37 is pressed against upper 12, as shown in FIG. 5, and in this position clevis 41 is moved towards the front. The frontward movement of clevis 31 is transmitted by rivet 42 to the extreme front part of support strap 44 which is pulled towards the front against the action of spring 47 which is compressed further on shoulder 49. Rear part 44*a* of support strap 44 is then out of the groove 46 and in this out position, it is located just above the end of upper arm 28*b* of pawl 28 to form an abutment permitting the locking of the gas supply control device 16 in the open position, such as previously described in reference to FIGS. 1–3.

If the heating device is in operation and the skier loosens upper 12 while forgetting to turn off the gas supply, the loosening of upper 12 causes movement of lever 37 into the position indicated in dotted lines in FIG. 5, and the consequent loosening of support strap 44. Strap 44 is thus pushed towards the rear under the action of spring 47. This movement is made possible by the sliding of rivet 42 in slot 43. Because of this rearward movement, rear part 44*a* of support strap 44 is retracted into groove 46 which is in the wall of upper 12, and therefore removes the abutment that it formed. The pawl 28 thus is freed and plate 21 can then slide upwardly to close supply valve 13 by its lug 15.

Although the invention has been described with reference to particular means, materials and embodiments, it is to be understood that the invention is not limited to the particulars disclosed and extends to all equivalents within the scope of the claims. For example, although the preceding description is directed to an alpine ski boot comprising, as an energy consuming device, a heating device, it is contemplated that the invention could apply likewise to any energy consuming device adapted, for example, to exert an automatic mechanical action.

Further, in the embodiment in which the heating assembly is of the electric type, in which case, a replaceable and/or rechargeable battery supply could be housed adjacent an upper of the boot which is connected to a resistance element or elements located proximate the internal sole of the boot. An electric switch could be provided in a location to be activated by the means for detecting the loosening of a portion of the boot to disconnect the battery supply to the resistance element or elements. For example, consistent with any of the disclosed embodiments, the control knob 24 located for convenient access for the wearer of the boot on the rear of the boot, e.g., could be used to act on the aforementioned switch, in which case, maintaining the actuation plate in the lower position would be effective to maintain the switch in the activated position for heating the boot. The activation and deactivation of the switch would be analogous to the opening and closing of the valve 13 by means of the lug 15 of actuation plate 21 acting on the pin 14, as shown in FIG. 1.

We claim:

1. A ski boot or shoe comprising an upper provided with means for tightening said upper, said boot or shoe including an energy source for supplying an energy consuming device, a device for controlling a supply element of the energy consuming device being connected between said energy source and said energy consuming device, further including means actuated by said means for tightening said upper so as to allow opening of said energy supply element when said upper is tightened and to automatically cause closing of said supply element in response to loosening of said upper, wherein said means actuated by said tightening means includes an element forming a retractable abutment, said retractable abutment being movable between an operative abutment position and an inoperative position, and a pawl for contacting said abutment when it is in said operative position to open said energy supply element.

2. The boot according to claim 1, further comprising a spring to bias said retractable abutment towards said inoperative position.

3. The boot according to claim 1, wherein said retractable abutment includes a portion of said upper which is cut so as to form a movable flap, said flap being defined by a U-shaped cutout which is joined to an upper portion of the rear wall of said upper and which is detached from the rest of the rear wall of said upper along its two lateral and vertical edges and its lower horizontal and transverse edge, said lower edge being adapted to form said abutment for said pawl, said means for tightening including at least one tightening cable, said tightening cable surrounding the upper part of said upper where said flap is formed and passing behind said flap.

4. The boot according to claim 3, wherein said flap includes a thickness which increases downwardly in the vertical and longitudinal cross-section so that said flap has substantially, the shape of a trapezoid whose large base constitutes a lower edge which forms an abutment.

5. The boot according to claim 3, wherein said flap is biased by a spring towards the exterior of the boot.

6. The boot according to claim 5, wherein said spring includes a curved blade which is affixed at its upper end to an upper part said upper and whose lower curved part rests against an internal surface of said flap.

7. The boot according to claim 1, wherein said boot is of the front entry type, said tightening of said upper being achieved by a cable surrounding the front of said upper, said cable being connected to a tightening lever, said tightening lever being journalled about an axis on an exterior clevis which can slide with respect said upper, said clevis being connected to a front end of a support strap which extends along the internal surface of said upper, said support strap including a rear part which extends above said pawl, an internal groove of the rear wall of said upper adapted to receive said support strap, said support strap being normally biased towards the rear by a spring.

8. The boot according to claim 7, wherein said clevis includes a rivet which extends through a slot provided in the wall of said upper, said rivet being affixed to the front end of said support strap.

9. The boot according to claim 7, wherein said spring is positioned in a slot provided in said front part of said support strap.

10. The boot according to claim 9, said wall including a shoulder projecting through said slot in said support strap, said spring resting at one end against said shoulder and at the other end against an edge of said slot.

11. The boot according to claim 1, wherein said energy consuming device is a heating apparatus.

12. A ski boot having an energy source to supply an energy consuming device, said ski boot comprising:

a) an upper having a rear wall with an interior surface;

b) means for tightening said upper about the leg of a wearer;

c) an energy consuming device having an energy source, and means for controlling a supply of energy from said energy source to said energy consuming device; and d) means actuated by said means for tightening said upper to control said means for controlling the supply of energy to allow the supply of energy from said energy source to said energy consuming device when said upper is tightened about the leg of the wearer and to automatically stop the supply of energy from said energy source in response to loosening of said upper, wherein said means actuated by said means for tightening includes a retractable abutment, said retractable abutment being movable between an operative abutment position and an inoperative position, and a pawl for contacting said abutment when said abutment is in said operative position, said pawl actuating said means for controlling the supply of energy when said pawl contacts said abutment.

13. The boot according to claim 12, further comprising a spring to bias said retractable abutment towards said inoperative position.

14. The boot according to claim 12, wherein said retractable abutment is a flap which is cut out of a portion of said rear wall of said upper, said flap including an upper portion which is connected to said rear wall and a lower edge which is detached from said rear wall, said lower edge forming said abutment.

15. The boot according to claim 13, wherein said means for tightening includes at least one cable passing around said flaps and said rear wall.

16. The boot according to claim 13, wherein said flap is thicker at said lower edge than at said upper portion.

17. The boot according to claim 14, further including a spring to bias said flap towards the exterior of the boot.

18. The boot according to claim 17, wherein said spring includes two ends and is connected to said rear wall of said upper at one end and to said flap at the other end.

19. The boot according to claim 12, wherein said boot is of the front entry type, said means for tightening including a cable surrounding the front of said upper and a tightening lever for tightening said cable around said upper, said tightening lever including a clevis which is slidable with respect to said upper, a support strap extending along the interior surface of said upper and positioned above said pawl, said clevis being connected to said support strap, a groove in the interior surface of said upper which is adapted to receive said support strap, and means for biasing said support strap towards said groove.

20. The boot according to claim 19, further comprising slot in said upper, said clevis including a rivet that extends through said slot and is fixed to said support strap.

21. The boot according to claim 19, wherein said means for biasing includes a spring.

22. The boot according to claim 21, wherein said support strap includes a slot, said spring being positioned in said slot.

23. The boot according to claim 22, wherein said upper includes a shoulder projecting through said slot in said support strap, said spring being position between said shoulder, and an edge of said slot.

24. The boot according to claim 12, wherein said energy consuming device comprises a heating apparatus.

25. An item of wearing apparel which includes means for receiving an extremity and means for selectively tightening and loosening a portion of said item of wearing apparel about said extremity, said item comprising:

(a) a gaseous energy source;

(b) an energy consuming device; and (c) means for controlling a connection between said energy source and said energy consuming device comprising means for preventing said connection in response to loosening said portion of said item of wearing apparel about said extremity by said means for selectively tightening and loosening a portion of said item of wearing apparel about said extremity, wherein said energy consuming device comprises a heating device.

26. The item of wearing apparel of claim 25, wherein said energy source is an electric battery.

27. The item of wearing apparel of claim 25, wherein said energy source is an interchangeable gas fuel cartridge.

28. The item of wearing apparel of claim 25, wherein said item of wearing apparel is a boot for receiving a foot.

29. The item of wearing apparel of claim 28, wherein said boot comprises an upper and wherein said energy source and said means for controlling a connection between said energy source and said energy consuming device is supported by said user.

30. The item of wearing apparel of claim 29, wherein said energy consuming device is a heating apparatus.

31. The item of wearing apparel of claim 25, wherein said means for preventing a connection between said energy source and said energy consuming device comprises means for detecting the loosening of said portion of said item of wearing apparel, wherein said supply of energy is prevented upon the detection of said loosening of said portion of said item of wearing apparel.

32. The item of wearing apparel of claim 31, wherein said means for controlling a connection between said energy source and said energy consuming device comprises a manually actuated energy supply switch movable at least between an ON position, in which said supply of energy is permitted between said energy source and said energy consuming device, and an OFF position, in which said supply of energy is prevented from said energy source, wherein said means for controlling a connection between said energy source and said energy consuming device comprises means for linking said means for detecting the loosening of said portion of said item of wearing apparel to said energy switch, wherein upon said detection of said loosening of said portion of said item of wearing apparel, said energy switch is permitted to move to said OFF position.

33. The item of wearing apparel of claim 32, further comprising means for biasing said energy switch toward said OFF position and means for maintaining said energy switch in said ON position against the force of said means for biasing in response to a failure of said means for detecting the loosening of said portion of said item of wearing apparel to detect the loosening of said portion of said item of wearing apparel.

34. The item of wearing apparel of claim 32, wherein said item of wearing apparel comprises footwear and wherein said energy consuming device is a heating apparatus.

35. The item of wearing apparel of claim 34, wherein said means for detecting the loosening of said portion of said item of wearing apparel comprises a member located proximate an upper of said boot which is moved by means for selectively tightening and loosening of said portion of said item of wearing apparel.

* * * * *